US005215880A

United States Patent [19]

Kojima et al.

[11] Patent Number: 5,215,880

[45] Date of Patent: Jun. 1, 1993

[54] SILVER HALIDE PHOTOGRAPHIC LIGHT-SENSITIVE MATERIAL CONTAINING TELLURIUM COMPOUND

[75] Inventors: Tetsuro Kojima; Hiroyuki Mifune; Hirotomo Sasaki; Morio Yagihara; Kimiyasu Morimura, all of Minami-ashigara, Japan

[73] Assignee: Fuji Photo Film Co., Ltd., Kanagawa, Japan

[21] Appl. No.: 879,902

[22] Filed: May 8, 1992

[30] Foreign Application Priority Data

May 8, 1991 [JP] Japan ..... 3-131598

[51] Int. Cl.[5] ..... G03C 1/09

[52] U.S. Cl. ..... 430/601; 430/603; 430/608; 430/610; 430/600

[58] Field of Search ..... 430/600, 601, 603, 610, 430/608

[56] References Cited

U.S. PATENT DOCUMENTS

| | | | |
|---|---|---|---|
| 3,297,447 | 1/1967 | McVeigh | 430/600 |
| 4,115,129 | 9/1978 | Bigelow | 430/601 |
| 5,079,138 | 1/1992 | Takada | 430/603 |

FOREIGN PATENT DOCUMENTS

| | | |
|---|---|---|
| 61-67845 | 4/1986 | Japan . |
| 61-277947 | 12/1986 | Japan . |

*Primary Examiner*—Charles L. Bowers, Jr.
*Assistant Examiner*—Janet C. Baxter
*Attorney, Agent, or Firm*—Birch, Stewart, Kolasch & Birch

[57] ABSTRACT

A silver halide photographic light-sensitive material of this invention is a silver halide photographic light-sensitive material having at least one silver halide emulsion layer on a support, wherein at least one of the silver halide emulsion layers contain at least one compound represented by formula (I): formula (I)

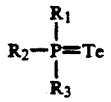

wherein $R_1$, $R_2$, and $R_3$ each represent an aliphatic group, an aromatic group, a heterocyclic group, $OR_4$, $NR_5(R_6)$, $SR_7$, $OSiR_8(R_9)(R_{10})$, $TeR_{11}$, X, or a hydrogen atom, $R_4$, $R_7$, and $R_{11}$ each represent an aliphatic group, an aromatic group, a heterocyclic group, a hydrogen atom, or a cation, $R_5$ and $R_6$ each represent an aliphatic group, an aromatic group, a heterocyclic group, or a hydrogen atom, $R_8$, $R_9$, and $R_{10}$ each represent an aliphatic group, and X represents a halogen atom.

18 Claims, No Drawings

SILVER HALIDE PHOTOGRAPHIC LIGHT-SENSITIVE MATERIAL CONTAINING TELLURIUM COMPOUND

BACKGROUND OF THE INVENTION

1. Field of the Invention

The present invention relates to a silver halide photographic light-sensitive material.

More particularly, the present invention relates to a silver halide photographic light-sensitive material using a silver halide emulsion, in which tellurium sensitization is performed with excellent reproducibility, the fog is reduced and the sensitivity is improved.

2. Description of the Related Art

A silver halide emulsion for use in a silver halide photographic light-sensitive material is generally subjected to chemical sensitization using various types of chemical substances to obtain desired sensitivity, gradation, and the like. Typical examples of the chemical sensitization are sulfur sensitization, selenium sensitization, tellurium sensitization, and noble metal sensitization using a noble metal such as gold, reduction sensitization, and various combinations thereof.

Recently, strong demands have arisen for high sensitivity, high graininess, and high sharpness of a silver halide photographic light-sensitive material and rapid processing in which the development speed or the like is increased.

Of the above sensitization methods, a tellurium sensitization method and a tellurium sensitizer are generally disclosed in U.S. Pat. Nos. 1,623,499, 3,320,069, 3,772,031, 3,531,289 and 3,655,394, British Patents 235,211, 1,121,496, 1,295,462, and 1,396,696, and Canadian Patent 800,958. A detailed and practical description of the tellurium sensitizer has been made in only a few references such as British Patent 1,295,462 and 1,396,696 and Canadian Patent 800,958.

Conventionally known practical tellurium sensitizers are colloidal tellurium and potassium telluride as exemplified in Canadian Patent 800,958. These tellurium sensitizers provide higher sensitivities than that in sulfur sensitization which is most popular in this industrial field. However, since colloidal tellurium is prepared using a strong reducing agent such as stannous chloride to leave the stannous chloride therein, and a good sensitizer with excellent reproducibility is hard to obtain due to the remaining stannous chloride and slight changes in preparation conditions. In addition, as for potassium telluride, the compound itself is not stable, is difficult to handle, and has poor reproducibility.

In addition to the above examples, some tellurium compounds are known as tellurium sensitizers. Tellurium compounds are generally labile compounds and often exhibit poor reproducibility in photographic performance. Strong demands have arisen for developing a stable tellurium sensitizer with excellent reproducibility.

SUMMARY OF THE INVENTION

It is the first object of the present invention to provide a silver halide photographic light-sensitive material in whose preparation step tellurium sensitization is performed with excellent reproducibility.

It is the second object of the present invention to stably provide a high sensitive silver halide photographic light-sensitive material.

The above objects are achieved by the following material, and the sensitization function of tellurium sensitization can be sufficiently enhanced, which has never been achieved by conventional techniques.

That is, the above objects can be achieved by, in a silver halide photographic light-sensitive material having at least one silver halide emulsion layer on a support, a silver halide photographic light-sensitive material wherein at least one of the silver halide emulsion layers contains at least one compound represented by formula (I) and, a silver halide photographic light-sensitive material characterized in that the material contains a sliver halide emulsion subjected to sensitization using at least one compound represented by formula (I):

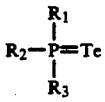

wherein $R_1$, $R_2$, and $R_3$ each represent an aliphatic group, an aromatic group, a heterocyclic group, $OR_4$, $NR_5(R_6)$, $SR_7$, $OSiR_8(R_9)(R_{10})$, $TeR_{11}$, X, or a hydrogen atom, $R_4$, $R_7$, and $R_{11}$ each represent an aliphatic group, an aromatic group, a heterocyclic group, a hydrogen atom, or a cation, $R_5$ and $R_6$ each represents an aliphatic group, an aromatic group, a heterocyclic group, or a hydrogen atom, $R_8$, $R_9$, and $R_{10}$ each represent an aliphatic group, and X represents a halogen atom.

DETAILED DESCRIPTION OF THE INVENTION

Formula (I) will be described in detail below.

In Formula (I), an aliphatic group represented by each of $R_1$, $R_2$, $R_3$, $R_4$, $R_5$, $R_6$, $R_7$, $R_8$, $R_9$, $R_{10}$, and $R_{11}$ preferably has 1 to 30 carbon atoms and is particularly a straight-chain, branched chain or cyclic alkyl, alkenyl, alkynyl, or aralkyl group having 1 to 20 carbon atoms. Examples of the alkyl, alkenyl, alkynyl, and aralkyl groups are methyl, ethyl, n-propyl, isopropyl, t-butyl, n-octyl, n-decyl, n-hexadecyl, cyclopentyl, cyclohexyl, allyl, 2-butenyl, 3-pentenyl, propargyl, 3-pentynyl, benzyl, and phenetyl.

In formula (I), an aromatic group represented by each of $R_1$, $R_2$, $R_3$, $R_4$, $R_5$, $R_6$, $R_7$, and $R_{11}$ is preferably a group having 6 to 30 carbon atoms and particularly a monocyclic or condensed-ring aryl group having 6 to 20 carbon atoms. Examples of the aryl group are phenyl and naphthyl.

In formula (I), a heterocyclic group represented by each of $R_1$, $R_2$, $R_3$, $R_4$, $R_5$, $R_6$, $R_7$, and $R_{11}$ is a 3- to 10-membered saturated or unsaturated heterocyclic group containing at least one atom selected from the group consisting nitrogen, oxygen, and sulfur. The heterocyclic group may be monocyclic or may form a condensed ring together with another aromatic or heterocyclic group. The heterocyclic group is preferably a 5- or 6-membered aromatic heterocyclic group, and examples thereof are pyridyl, furyl, thienyl, thiazolyl, imidazolyl, benzimidazolyl, and morpholino.

In formula (I), a cation represented by each of $R_4$, $R_7$, and $R_{11}$ is an alkali metal or ammonium.

In formula (I), examples of a halogen atom represented by X are fluorine, chlorine, bromine, and iodine.

The aliphatic, aromatic, and heterocyclic groups may have substituents.

The following substituents are exemplified.

Typical examples of the substituents are alkyl, aralkyl, alkenyl, alkynyl, aryl, alkoxy, aryloxy, amino, acylamino, ureido, an urethane group, sulfonylamino, sulfamoyl, carbamoyl, sulfonyl, sulfinyl, alkyloxycarbonyl, aryloxycarbonyl, acyl, acyloxy, phosphoamido, diacylamino, imido, alkylthio, arylthio, a halogen atom, cyano, sulfo, carboxy, hydroxy, phosphono, nitro, phosphinetelluroyl, and a heterocyclic group. These groups may have other substituents.

If two or more substituents are contained, they may be the same or different.

$R_1$, $R_2$, and $R_3$ may be combined to each other to form a ring together with a phosphorus atom (including an N,P alkyldiazadiphosphethidine ring), or $R_5$ and $R_6$ may be combined to each other to form a nitrogen-containing heterocyclic ring.

In formula (I), preferably $R_1$, $R_2$, and $R_3$ each represent an aliphatic group, an aromatic group, $OR_4$, or $NR_5(R_6)$, and $R_4$, $R_5$, and $R_6$ each represent an aliphatic or aromatic group.

In formula (I), more preferably, $R_1$, $R_2$, and $R_3$ each represent a straight-chain, branched chain or cyclic alkyl group or aromatic group.

Practical examples of compounds represented by formula (I) of the present invention will be described below. However, the present invention is not limited to these compounds.

1. $(nC_4H_9)_3P{=}Te$

2. $(tC_4H_9)_3P{=}Te$

3. 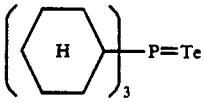

4. $(C_2H_5)_3P{=}Te$

5. $(nC_3H_7)_3P{=}Te$

6. $(iso\text{-}C_3H_7)_3P{=}Te$

7. 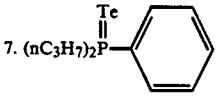

8. 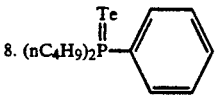

9. 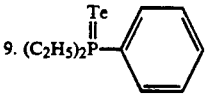

10. $(isoC_4H_9)_3P{=}Te$

11. $(nC_8H_{17})(isoC_3H_7)_2P{=}Te$

12. $(nC_4H_9)_2(isoC_3H_7)P{=}Te$

13. $(isoC_4H_9)(isoC_3H_7)_2P{=}Te$

14. $(isoC_4H_9)_2(isoC_3H_7)P{=}Te$

15. $(nC_4H_9)(isoC_3H_7)_2P{=}Te$

16. $C_2H_5\overset{Te}{\overset{\|}{P}}(OC_2H_5)_2$

17. $H_2C{=}CHCH_2\overset{Te}{\overset{\|}{P}}(OC_2H_5)_2$

18. $C_2H_5\overset{Te}{\overset{\|}{P}}(-N(CH_3)_2)_2$

19. 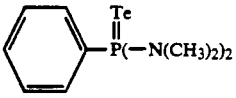

20. $CH_3\overset{Te}{\overset{\|}{P}}(-N(C_2H_5)_2)_2$

21. $((CH_3)_2N)_3P{=}Te$

-continued

22. $((C_2H_5)_2N)_2\overset{Te}{\overset{\|}{P}}(CH_2)_4\overset{Te}{\overset{\|}{P}}(-N(C_2H_5)_2)_2$ 23. 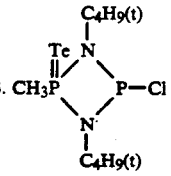

24. 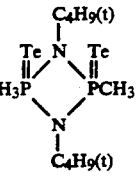

25. 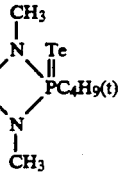

26. $(nC_5H_{11})_3P{=}Te$

27. $((CH_3)_3SiO)_2\overset{Te}{\overset{\|}{P}}H$

28. $(CD_3)_3P{=}Te$

29. $(CH_3)_3P{=}Te$

30. 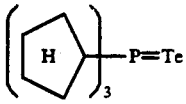

31. 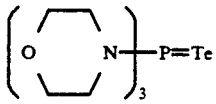

32. 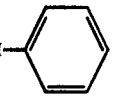

33. $C_2H_5O\overset{Te}{\overset{\|}{P}}(N(C_2H_5)_2)_2$

34. $CH_3\overset{Te}{\overset{\|}{P}}(N(CH_3)_2)_2$

35. $(C_2H_5)_2\overset{Te}{\overset{\|}{P}}N(C_2H_5)_2$

36. $(C_2H_5)_2N)_3P{=}Te$

37. $H_2\overset{Te}{\overset{\|}{P}}NH_2$

38. $(C_8H_{17})_3P{=}Te$

39. $HP(OH)_2$

40. $HP(NH_2)_2$

41. $(H_2N)_3P{=}Te$

42. 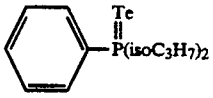

43. 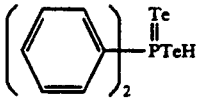

44. 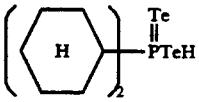

45. 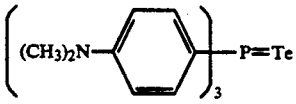

A compound represented by formula (I) according to the present invention can be synthesized with reference to known publications such as J. Chem. Soc. (A), 1969, 2927; J. Organomet. Chem., vol. 4., 320 (1965); ibid., 1, 200 (1963); ibid., vol. 113, C35 (1976); Phosphorus Sulfur, vol. 15, 155 (1983); and Chem. Ber vol., 2996 (1976).

No practical example of applying the compound of formula (I) as a tellurium sensitizer has yet been reported. Therefore it was very difficult to predict good sensitization and antifoggant effects and other photographic effects obtained by these compounds. However, significant effects could be obtained using the compounds.

Although the amount of the tellurium sensitizer used changes in accordance with the types of silver halide grains and the chemical ripening conditions, it is generally $10^{-8}$ to $10^{-2}$ mol, and preferably $10^{-7}$ to $5\times10^{-3}$ mol per mol of a silver halide.

Although the chemical sensitization conditions for the tellurium sensitizer are not particularly limited, the pAg is 6 to 11, and preferably 7 to 10 and the temperature is 40° C. to 95° C., and preferably 50° C. to 85° C.

Tellurium sensitization can be normally performed at any time until coating of silver halide grains immediately after their formation. Tellurium sensitization is preferably performed in a chemical sensitization step after washing. In some cases, tellurium sensitization may be performed during formation of grains for an autopositive emulsion.

In the present invention, a noble metal sensitizer such as gold, platinum, palladium, or iridium is preferably used together with the tellurium sensitizer. The use of a gold sensitizer together with the tellurium sensitizer is particularly preferable. Examples of the gold sensitizer are for example, chloroauric acid, potassium chloroaurate, potassium aurithiocyanate, gold sulfide, and gold selenide. The noble metal sensitizer can be used in an amount of about $10^{-7}$ to $10^{-2}$ mol per mol of a silver halide.

In the present invention, further a sulfur sensitizer is also preferably used together. Examples of the sulfur sensitizer are known labile sulfur compounds such as a thiosulfate (for example, hypo), thioureas (for example, diphenylthiourea, triethylthiourea, and arylthiourea), and rhodanines. The sulfur sensitizer can be used in an amount of about $10^{-7}$ to $10^{-2}$ mol per mol of a silver halide.

In the present invention, a selenium sensitizer is also preferably used.

For example, a labile selenium sensitizer described in JP-B-44-15748 ("JP-B-" means Published Examined Japanese Patent Application) is preferably used.

Examples of the labile selenium sensitizer are compounds such as colloidal selenium, selenoureas (for example, N,N-dimethylselenourea, selenourea, and tetramethylselenourea), selenoamides (for example, selenoacetoamide and N,N-dimethyl-selenobenzamide), selenoketones (for example, selenoacetone and selenobenzophenone), selenides (for example, triphenylphosphineselenide and diethylselenide), selenophosphates (for example, tri-p-trylselenophosphate), selenocarboxylic acid and its esters, and isoselenocyanates. The labile selenium sensitizer can be used in an amount of about $10^{-8}$ to $10^{-3}$ mol per mol of a silver halide.

In the present invention, further a reduction sensitizer can also be used together. Examples of the reduction sensitizer are stannous chloride, aminoiminomethanesulfinic acid, a hydrazine derivative, a borane compound (for example, dimethylamineborane), a silane compound, and a polyamine compound.

In the present invention, the tellurium sensitization is preferably performed in the presence of a silver halide solvent.

Examples of the silver halide solvent are a thiocyanate (for example, potassium thiocyanate), a thioether compound (for example, compounds described in U.S. Pat. Nos. 3,021,215 and 3,271,157, JP-B-58-30571, and JP-A-60-136736 ("JP-A-" means Published Unexamined Japanese Patent Application), in particular, 3,6-dithia-1,8-octanediol), a tetra-substituted thiourea compound (for example, compounds described in JP-B-59-11892 and U.S. Pat. No. 4,221,863, in particular, tetramethylthiourea), a thione compound described in JP-B-60-11341, a mercapto compound described in JP-B-63-29727, a meso-ionic compound described in JP-A-60-163042, a selenoether compound described in U.S. Pat. No. 4,782,013, a telluroether compound described in JP-A-2-118566, and a sulfite. Of these compounds, a thiocyanate, a thioether compound, a tetra-substituted thiourea compound, and a thione compound can be particularly preferably used. The silver halide solvent can be used in an amount of about $10^{-5}$ to $10^{-2}$ mol per mol of a silver halide.

Preferable examples of a tellurium-sensitized silver halide emulsion and a silver halide emulsion used with the tellurium-sensitized silver halide emulsion according to the present invention are silver bromide, silver iodobromide, silver iodochlorobromide, silver chlorobromide, and silver chloride.

A silver halide grain to be subjected to tellurium sensitization according to the present invention may have a regular crystal shape such as a cube or an octahedron, an irregular crystal shape such as a sphere or a plate, or a composite shape thereof. Although a mixture of grains having various crystal shapes can be used, the use of a regular crystal shape is preferred.

A tellurium-sensitized silver halide emulsion and a silver halide emulsion used together with the tellurium-sensitized silver halide emulsion according to the present invention may have different phases in the interior and the surface layer thereof or may consist of a uniform phase. A grain having a double structure or a multistructure having different iodine compositions between the interior of the grain and the surface layer thereof (particularly one having a higher iodine content in the grain interior) is also preferable. The silver halide grain may be a grain on the surface of which a latent image is mainly formed (for example, a negative type emulsion) or a grain in the interior of which it is mainly formed (for example, an internal latent image emulsion or a fogged direct reversal type emulsion). The silver halide grain is preferably the grain on the surface of which a latent image is mainly formed.

A tellurium-sensitized silver halide emulsion and a silver halide emulsion used together with the tellurium-sensitized silver halide emulsion used in the present invention are tabular grain emulsions in which 50% or more of a total projected is occupied by grains having a thickness of 0.5 microns or less, and preferably, 0.3 microns or less, a diameter of 0.6 microns or more, and an average aspect ratio of 3 or more, or monodisperse emulsions in which a statistical variation coefficient (a value of S/d obtained by dividing a standard deviation S by an average diameter d in a distribution of circle-approximated diameter of a projected surface area) is 20% or less. Alternatively, two or more types of tabular grain emulsions and monodisperse emulsions may be mixed.

A tellurium-sensitized silver halide emulsion and a silver halide emulsion used together with the tellurium-sensitized silver halide emulsion used in the present invention can be prepared by methods described in, for example, P. Glafkides, "Chimie et Physique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

To control growth of grains during formation of silver halide grains, ammonia, potassium thiocyanate, ammonium thiocyanate, a thioether compound (for example, U.S. Pat. Nos. 3,271,157, 3,574,628, 3,704,130, 4,297,439, and 4,276,374), a thione compound (for example, JP-A-53-144319, JP-A-53-82408, and JP-A-55-77737), and an amine compound (for example, JP-A-54-100717) can be used as a silver halide solvent.

During silver halide grain formation or physical ripening, a cadmium salt, a zinc salt, a thallium salt, an iridium salt or its complex salt, a rhodium salt or its derivative, and an iron salt or iron complex salt may be used.

Gelatin can be advantageously used as a binder or a protective colloid which can be used in emulsion and intermediate layers of the light-sensitive material of the present invention. Also another hydrophilic colloid can be used. Examples are a gelatin derivative, a graft polymer of gelatin and another polymer, proteins (for example, albumin and casein), cellulose derivatives (for example, hydroxyethyl cellulose, carboxymethyl cellulose, and cellulose sulfate), sodium alginate, saccharide derivatives (for example, a starch derivative), and various synthetic hydrophilic polymer materials such as homopolymer or copolymer materials of, for example, polyvinyl alcohol, polyvinyl alcohol partial acetal, poly-N-vinylpyrolidone, polyacrylic acid, polymethacrylic acid, polyacrylamide, polyvinyl imidazole, and polyvinyl pyrazole.

Gelatin may be a general lime-processed gelatin or an acid-processed gelatin, or may be an enzyme-processed as described in Bull. Soc. Phot. Japan, No. 16, p. 30, (1966). In addition, a hydrolyzate of gelatin may also be used.

In a light-sensitive material according to the present invention, an inorganic or organic film hardening agent may be contained in any hydrophobic colloid layer constituting the light-sensitive or back layer. Examples of the film hardening agent are a chromium salt, aldehyde salts (for example, formaldehyde, glyoxal and glutaraldehyde), and N-methylol compounds (for example, dimethylol urea). An active halogen compound (for example, 2,4-dichloro-6-hydroxy-1,3,5-triazine, and its sodium salt) and an active vinyl compound (for example, 1,3-bisvinylsulfonyl-2-propanol, 1,2-bis(vinylsulfonylacetoamido)ethane, bis(vinylsulfonylmethyl)ether, or a vinyl-based polymer having a vinylsulfonyl group as a side chain) are preferable to quickly harden the hydrophilic colloid such as gelatin and provide stable photographic characteristics. N-carbamoilpyridinium salts (for example, 1-morpholinocarbonyl-3-pyridinio)methanesulfonate) and haloamidinium salts (for example, 1-(1-chloro-1-pyridinomethylene)pyrolidinium-2-naphthal enesulfonate) have high hardening speeds.

A tellurium-sensitized silver halide emulsion and a silver halide emulsion used together with the tellurium-sensitized silver halide emulsion may be spectrally sensitized with methine dyes and others. The methine dye includes a cyanine dye, a merocyanine dye, a composite cyanine dye, a composite merocyanine dye, a holopolar cyanine dye, a hemicyanine dye, a styryl dye, and a hemioxonol dye. Particularly useful dyes are dyes belonging to the cyanine, merocyanine, and composite merocyanine dyes. In these dyes, any nucleus normally used as a basic heterocyclic nucleus in cyanine dyes can be used. Examples of the nucleus are a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus; a nucleus obtained by fusing an alicyclic hydrocarbon ring to each of the above nuclei; and a nucleus obtained by fusing an aromatic hydrocarbon ring to each of the above nuclei, e.g., an indolenine nucleus, a benzindolenine nucleus, an indole nucleus, a benzoxadole nucleus, a naphthooxadole nucleus, a benzothiazole nucleus, a naphthothiazole nucleus, a benzoselenazole nucleus, a benzimidazole nucleus, and a quinoline nucleus. These nuclei may have substituents on carbon atoms.

For a merocyanine dye or composite merocyanine dye, a 5- or 6-membered heterocyclic nucleus, e.g., a pyrazoline-5-one nucleus, a thiohydantoin nucleus, a 2-thiooxazoline-2,4-dione nucleus, a thiazoline-2,4-dione nucleus, a rhodanine nucleus, or a thiobarbituric acid nucleus can be used as a nucleus having a ketonmethylene structure.

These sensitizing dyes may be used singly or in combinations. Combinations of the sensitizing dyes are often used for supersensitization. In addition to the sensitizing dye, a dye not having a spectral sensitizing effect or a substance essentially not absorbing visible light but exhibiting supersensitization may be added to the emulsion. Examples of the substance are a substituted aminostilbene compound as a nitrogen-containing heterocyclic group (described in, e.g., U.S. Pat. No. 2,933,390 or 3,635,721), an aromatic organic acid formaldehyde condensate (described in, e.g., U.S. Pat. No. 3,743,510), a cadmium salt, and an azaindene compound. Combinations described in U.S. Pat. Nos. 3,615,613, 3,615,641, 3,617,295, and 3,635,721 are most effective.

A tellurium-sensitized silver halide emulsion and a silver halide emulsion used together with the tellurium-sensitized silver halide emulsion in the present invention can contain various compounds in order to prevent fog during manufacture, storage, or a photographic treatment of the light-sensitive material or to stabilize photographic properties. Many kinds of compounds known as an antifoggant or stabilizer can be used. Examples are azoles such as a benzothiazolium salt, nitroimidazoles, nitrobenzimidazoles, chlorobenzimidazoles, bromobenzimidazoles, mercaptothiazoles, mercaptobenzthiazoles, mercaptobenzimidazoles, mercaptothidiazoles, mercaptotriazoles, aminotriazoles, benzotriazoles, nitrobenzotriazoles, and mercaptotetrazoles (especially 1-phenyl-5-mercaptotetrazole); mercaptopyrimidines; mercaptotriazines; a thioketo compound such as oxyadolinethione; azaindenes such as triazaindenes, tetraazaindenes (especially 4-hydroxy-substituted(1,3,3a,7)tetraazaindenes), pentaazaindenes; benzenethiosulfonic acids; benzenesulfinic acids; and benzenesulfonic acid amides.

A light-sensitive material according to the present invention may contain at least one surfactant for various application purposes such as a coating aid, an antistatic purpose, a slipping improvement, emulsion dispersion, adhesion resistance, and improvements of photographic characteristics (for example, developing acceleration, high contrast, and sensitization).

A light-sensitive material prepared by the present invention may contain an aqueous dye as a filter dye in a hydrophilic colloid layer for anti-irradiation or anti-halation purpose and other application purposes. Examples of such a dye are an oxonol dye, a hemioxonol dye, a styryl dye, a merocyanine dye, an anthraquinone dye, and an azo dye. A cyanine dye, an azomethine dye, a triarylmethane dye, and a phthalocyanine dye are also useful. An oil-soluble dye can be emulsified in accordance with an oil-in-water dispersion method and can be added to a hydrophilic colloid layer.

The present invention can be applied to a multilayered multicolor photographic material having at leas two different spectral sensitivities on a support.

A multilayered natural color photographic material generally has at least one red-sensitive emulsion layer, at least one green-sensitive emulsion layer, and at least one blue-sensitive emulsion layer, all of which are formed on a support. An arrangement order of these layers can be arbitrarily selected, as needed. A preferable layer arrangement is an order of red-, green-, and blue-sensitive emulsion layers, an order of blue-, green-, and red-sensitive emulsion layers, or an order of blue-, red-, and green-sensitive emulsion layers from the support side. Any color sensitive emulsion layer may be constituted by at least two layers having different sensitivities to obtain a higher final sensitivity, or a three-layered structure may be employed to further improve graininess. A non-light-sensitive layer may be present between at least two emulsion layers having the same color sensitivity. Alternatively, an emulsion layer having a color sensitivity different from those of two emulsion layers having the same color sensitivity may be sandwiched between these two emulsion layers. A reflecting layer of, e.g., a fine grain silver halide may be formed under a high-speed layer and particularly a high-speed blue-sensitive layer.

A cyan dye formation coupler is generally contained in a red-sensitive emulsion layer, a magenta dye formation coupler is generally contained in a green-sensitive emulsion layer, and a yellow dye formation coupler is generally contained in a blue-sensitive emulsion layer. However, another combination may be used as needed. For example, infrared-sensitive layers may be combined to obtain a pseudo color photograph or achieve semiconductor laser exposure.

Various color couplers can be used in the present invention, and specific examples of these couplers are described in patents described in above-mentioned Research Disclosure (RD), No. 17643, VII-C to VII-G.

Preferred examples of a yellow coupler are described in, e.g., U.S. Pat. Nos. 3,933,501, 4,022,620, 4,326,024, and 4,401,752, JP-B-58-10739, and British Patents 1,425,020 and 1,476,760.

Examples of a magenta coupler are preferably 5-pyrazolone and pyrazoloazole compounds, and more preferably, compounds described in, e.g., U.S. Pat. Nos. 4,310,619 and 4,351,897, EP 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, and U.S. Pat. Nos. 4,500,630 and 4,540,654.

Examples of a cyan coupler are phenol and naphthol couplers, and preferably, those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Application (OLS) No. 3,329,729, EP 121,365A, U.S. Pat. Nos. 3,446,622, 4,333,999, 4,451,559, and 4,427,767, and EP 161,626A.

Preferable examples of a colored coupler for correcting additional, undesirable absorption of a colored dye are those described in Research Disclosure No. 17643, VII-G, U.S. Pat. No. 4,163,670, JP-B-57-39413, U.S. Pat. Nos. 4,004,929 and 4,138,258, and British Patent 1,146,368.

Preferable examples of a coupler capable of forming colored dyes having proper diffusibility are those described in U.S. Pat. No. 4,366,237, British Patent 2,125,570, EP 96,570, and West German Patent Application (OLS) No. 3,234,533.

Typical examples of a polymerized dye-forming coupler are described in U.S. Pat. Nos. 3,451,820, 4,080,221, and 4,367,288, and British Patent 2,102,173

Couplers releasing a photographically useful moiety upon coupling are preferably used in the present invention. DIR couplers, i.e., couplers releasing a development inhibitor are described in the patents cited in the above-described RD No. 17643, VII-F, JP-A-57-151944, JP-A-57-154234, and JP-A-60-184248, and U.S. Pat. No. 4,248,962.

Preferable examples of a coupler for image-wise releasing a nucleating agent or a development accelerator are described in British Patents 2,097,140 and 2,131,188, JP-A-59-157638, and JP-A-59-170840.

Examples of a coupler which can be used in the light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; a DIR redox compound or DIR coupler releasing coupler described in, e.g., JP-A-60-185950 and JP-A-62-24252; couplers releasing a dye which turns to a colored form after being released described in EP 173,302A bleaching accelerator releasing couplers described in, e.g., RD. Nos. 11,449 and 24,241 and JP-A-61-201247; and a legand releasing coupler described in, e.g., U.S. Pat. No. 4,553,477.

Couplers used in the present invention can be introduced into light-sensitive materials in accordance with various known dispersion methods.

An example of a high-boiling organic solvent used in the oil-in-water dispersion method is described in U.S. Pat. No. 2,322,027.

Examples of a high-boiling organic solvent to be used in the oil-in-water dispersion method and having a boiling point of 175° C or more at atmospheric pressure are phthalic esters (e.g., dibutylphthalate, dicyclohexylphthalate, di-2-ethylhexylphthalate, decylphthalate, bis(2,4-di-t-amylphenyl)phthalate, bis(2,4-di-t-amylphenyl)isophthalate, bis(1,1-di-ethylpropyl)phthalate), phosphates or phosphonates (e.g., triphenylphosphate, tricresylphosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, and di-2-ethylhexylphenyl phosphorate), benzoates (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearylalcohol and 2,4-di-tert-amylphenol), aliphatic carboxylates (e.g., bis(2-ethylhexyl)sebacate, dioctylazelate, glyceroltributylate, isostearyllactate, and trioctylcitrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as a co-solvent. Typical examples of the co-solvent are ethyl acetate, butyl acetate, ethyl propionate, methylethylketone, cyclohexanone, 2-ethoxyethylacetate, dimethylformamylketone, cyclohexanone, 2-ethoxyethylacetate, and dimethylformamide.

Steps and effects of a latex dispersion method and examples of a loadable latex are described in, e.g., U.S. Pat. No. 4,199,363 and West German Patent Application (OLS) Nos. 2,541,274 and 2,541,230.

Photographic emulsion layers and other layers in photographic light-sensitive materials of the present invention are coated on a flexible support such as a plastic film, paper, or cloth normally used for a photographic light-sensitive material or a rigid support made of a ceramic or metal. Examples of the useful flexible support are a film of a semisynthetic or synthetic polymer such as cellulose nitrate cellulose acetate, cellulose acetate butyrate, polystyrene, polyvinyl chloride, polyethylene terephthalate, or polycarbonate; or paper coated or laminated with a baryta layer or α-olefin polymer (for example, polyethylene, polypropylene, or an ethylene/butene copolymer). The support may be colored with a dye or pigment, or may be colored in black for the light-shielding purpose. Undercoating is performed on the surface of such a support to improve adhesion with photographic emulsion layers. Glow discharge, corona discharge, ultraviolet radiation, or flame treatment of the support surface may be performed before or after undercoating.

Coating of photographic emulsion layers and other hydrophilic colloid layers can be performed using various known coating methods such as a dipping coating method, a roller coating method, a curtain coating method, and an extrusion coating method. A large number of layers may be simultaneously coated in accordance with coating methods described in U.S. Pat. Nos. 2,681,294, 2,761,791, 3,526,528, and 3,508,947 as needed.

The photographic emulsion of the present invention can be applied to various types of color and black/white light-sensitive materials. Typical examples are color negative films for general purposes and motion pictures, color reversal films for slides and TV, color paper, a color positive film, color reversal paper, a color diffusion transfer type light-sensitive material, and a thermal development type color light-sensitive material. Mixing of three color couplers described in Research Disclosure No. 17,123 (July, 1978) is utilized, or a black color forming coupler described in U.S. Pat. No. 4,126,461 and British Patent 2,102,136 is utilized to apply the present invention to an X-ray black-and-white light-sensitive material. The photographic emulsion of the present invention can also be applied to process films such as a lith film and a scanner film, X-ray films for direct/indirect medical purposes and industrial purposes, a photographic negative black/white film, black/white photographic printing paper, microfilms for COM and general purposes, a silver salt diffusion transfer type light-sensitive material, and a printout type light-sensitive material.

When the photographic elements according to the present invention are applied to a color diffusion transfer process, a peel (peel apart) type film unit, an integrated type film unit described in JP-B-46-16356 and JP-B-48-33697, JP-A-50-13040, and British Patent 1,330,524, or a peel free type film unit described in JP-A-57-119345 can be used.

In any of the above formats, it is advantageous to use a polymer acid layer protected with a neutralization timing layer in order to increase an tolerance of processing temperatures. When a color diffusion transfer process is used, the polymer acid layer may be added to any of the layers in the light-sensitive material or may be sealed in the processing solution container as a developing solution component.

Various exposing means can be used for the light-sensitive materials according to the present invention. An arbitrary light source for emitting radiation corresponding to a sensitivity wavelength of a light-sensitive material can be used as an illumination light source or a write light source. Natural light (sunbeam), an incandescent lamp, a halogen atom-sealed lamp, a mercury lamp, a fluorescent lamp, or a flash light source (for example, an electronic flash or a metal combustion flash bulb) can be generally used.

A gas, dye solution, or semiconductor laser, a light-emitting diode, or a plasma light source for emitting light ranging from an ultraviolet range to an infrared range can be used as a recording light source. In addition, an exposing means as a combination of a linear or surface light source with a fluorescent screen (for example, a CRT) for emitting light upon excitation of fluorescent substances by electron beams, a liquid crystal (LCD), or a microshutter array utilizing lanthanum-doped lead-titanium zirconate (PLZT) can be used. The spectral distribution used in exposure can be adjusted by a color filter, as needed.

A color developer used in development of the photosensitive material of the present invention is preferably an aqueous alkaline solution containing an aromatic primary amine-based color developing agent as a main component. As this color developing agent, although an aminophenol-based compound is effective, a p-phenylenediamine-based compound is preferably used. Typical examples of the p-phenylenediamine-based compound are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylani line, 3-methyl-4-amino-N-ethyl-N-β-methoxyethylaniline, and sulfates, hydrochlorides and p-toluenesulfonates thereof. These diamines are generally more stable in the form of salts than in a free state and are preferably used in the form of salts.

In general, the color developer contains a pH buffering agent such as a carbonate, a borate, or a phosphate of an alkali metal, and a development restrainer or an antifoggant such as a bromide, an iodide, benzimidazoles, benzothiazoles, or a mercapto compound. If necessary, the color developer may also contain a preservative such as hydroxylamine or a sulfite; an organic solvent such as triethanolamine or diethyleneglycol; a development accelerator such as benzylalcohol, polyethyleneglycol, a quaternary ammonium salt or an amine; a dye forming coupler; a competing coupler; a nucleating agent such as sodium boron halide; an auxiliary developing agent such as 1-phenyl-3-pyrazolidone; a viscosity imparting agent; a chelating agent such as aminopolycarboxylic acid, an aminopolyphosphonic acid, an alkylphosphonic acid, or a phosphonocarboxylic acid; and an antioxidant described in West Germany Patent Application (OLS) 2,622,950.

In order to perform reversal development, normally, black-and-white development is performed and then color development is performed. As a black-and-white developer, well-known black-and-white developing agents, e.g., dihydroxybenzenes such as hydroquinone, 3-pyrazolidones such as 1-phenyl-3-pyrazolidone, and aminophenols such as N-methyl-p-aminophenol can be used singly or in a combination of two or more thereof.

The photographic emulsion layer is generally subjected to bleaching after color development. The bleaching may be performed either simultaneously with fixing or independently thereof. In order to shorten the processing time, a bleaching-fixing step may be performed after bleaching. Examples of the bleaching agent are a compound of a multivalent metal such as iron(III), cobalt(III), chromium(VI), and copper(II); peroxides; quinones; and a nitro compound. Typical examples of the bleaching agent are: a ferricyanide; a dichromate; an organic complex salt of iron(III) or cobalt(III), e.g., a complex salt of an aminopolycarboxylic acid such as ethylenediaminetetraacetic acid, diethylenetriaminepentaacetic acid, nitrilotriacetate, and 1,3-diamino-2-propanoltetraacetate, or a complex salt of an organic acid such as citric acid, tartaric acid, or malic acid; a persulfate; a manganate; and nitrosophenol. Of these compounds, an iron(III) complex salt of ethylenediaminetetraacetic acid, an iron(III) complex salt of diethylenetriaminepentaacetic acid, and a persulfate are preferable because they can increase the processing speed and prevent an environmental contamination. The iron(III) complex salt of ethylenediaminetetraacetic acid is useful in both the bleaching and bleach-fixing solutions.

A bleaching accelerator can be used in the bleaching solution, the bleach-fixing solution, and their pre-bath, if necessary. Useful examples of the bleaching accelerator are: compounds having a mercapto group or a disulfide group described in, e.g., U.S. Pat. No. 3,893,858, West German Patents 1,290,812 and 2,059,988, JP-A-53-32736, JP-A-53-57831, JP-A-37418, JP-A-53-65732, JP-A-53-72623, JP-A-53-95630, JP-A-53-95631, JP-A-53-104232, JP-A-53-124424, JP-A-53-141623, and JP-A-53-28426, and Research Disclosure No. 17,129 (July, 1978); a thiazolidine derivative described in JP-A-50-140129; a thiourea derivative described in JP-B-45-8506, JP-A-52-20832, JP-A-53-32735, and U.S. Pat. No. 3,706,561; an iodide described in West German Patent 1,127,715, and JP-A-58-16235; polyethylene oxide compounds described in West German Patents 966,410 and 2,748,430; a polyamine compound described in JP-B-45-8836; and compounds and iodide and bromide ions descried in JP-A-49-42434, JP-A-49-59644, JP-A-53-94927, JP-A-54-35727, JP-A-55-26506, and JP-A-S8-163940. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

Examples of the fixing agent include a thiosulfate salt, a thiocyanate salt, a thioether-based compound, a thiourea, and a large amount of an iodide. However, a thiosulfate is normally used. Preferable examples of the preservative for the bleaching-fixing solution and the fixing solution include a sulfite salt, a bisulfite salt, and a carbonyl bisulfite adduct.

Upon completion of the bleaching-fixing step or fixing step, a washing step and a stabilizing step are generally performed. In the washing and stabilizing steps, various known compounds may be added to prevent precipitation or save water. In order to prevent the precipitation, for example, a water softener such as inorganic phosphoric acid, aminopolycarboxylic acid, organic aminopoysulfonic acid, or organic phosphoric acid may be added. A germicide and an antifungal agent for preventing generation of various bacteria, algae, and fungi, metal salts represented by a magnesium salt, an aluminum salt, and a bismuth salt, a surfactant for reducing a drying load and eliminating coating unevenness, and various hardening agents can be added as needed. A compound described in L. E. West, Phot. SCi. Eng., Vol. 6, pp. 344–359 (1965) may be added. It is especially effective to add a chelating agent and an antifungal agent.

The washing step is generally performed by using two or more tanks in accordance with a counter-current scheme, thereby saving the water. A multi-stage counter-current stabilizing step a described in JP-A-57-8543 may be performed in place of the washing step. In the step, two to nine counter tanks are required. Various compounds are added to the stabilizing bath to stabilize an image in addition to the additives described above. Examples of these compounds are: various buffer agents (for example, a borate, a metaborate, borax, a phosphate, a carbonate, potassium hydroxide, sodium hydroxide, ammonia water, monocarboxylic acid, dicarboxylic acid, and polycarboxylic acid are used in combinations) for adjusting the pH of a film (for example, pH 3 to 9); and an aldehyde such as formalin. In addition, various additives such as a chelating agent (for example, inorganic phosphoric acid, aminopolycarboxylic acid, organic phosphoric acid, organic phosphoric acid, aminopolyphosphonic acid, or phosphonocarboxylic acid), a germicide (for example, benzoisothiazolinone, isothiazolone, 4-thiazoline, benzimidazole, halogenated phenol, sulfanylamide, or benzotriazole), a surfactant, a fluorescent whitener, and a film hardening agent. At least two compounds having the same or different purposes may be used.

Various ammonium salts such as ammonium chloride, ammonium nitrate, ammonium sulfate, ammonium phosphate, ammonium sulfite, and ammonium thiosulfate are preferably added as pH adjusting agents after the film is processed.

In a color light-sensitive material for photographing washing-stabilizing step normally performed after fixing can be replaced with the stabilizing and washing (water saving processing) steps described above. In this case, if a 2-equivalent magenta coupler is used, formalin in the stabilizing bath may be eliminated.

The washing and stabilizing processing times of the present invention vary depending on the types of light-sensitive materials and processing conditions but normally fall within the range of 20 seconds to 10 minutes and preferably 20 seconds to 5 minutes.

The silver halide color light-sensitive material of the present invention may contain a color developing agent in order to simplify processing and increase the processing speed. For this purpose, various types of precursors of a color developing agent can be preferably used.

Examples of the precursor are an indoaniline-based compound described in U.S. Pat. No. 3,342,597, Schiff base compounds described in U.S. Pat. No. 3,342,599 and Research Disclosure (RD) Nos. 14,850 and 15,159, an aldol compound described in RD No. 13,924, a metal salt complex described in U.S. Pat. No. 3,719,492, and an urethane-based compound described in JP-A-53-135628. In addition, various salt type precursors described in JP-A-56-6235, JP-A-56-16133, JP-A-56-59232, JP-A-56-67842, JP-A-56-83734, JP-A-56-83735, JP-A-56-83736, JP-A-56-89735, JP-A-56-81837, JP-A-56-54430, JP-A-56-106241, JP-A-56-107236, JP-A-57-97531, and JP-A-57-83565 are exemplified.

The silver halide color light-sensitive material of the present invention may contain various 1-phenyl-3-pyrazolidones in order to accelerate color development, if necessary. Typical examples of the compound are described in JP-A-56-64339, JP-A-57-144547, JP-A-57-211147, JP-A-58-50532, JP-A-58-50536, JP-A-58-50533, JP-A-58-50534, JP-A-58-50535, and JP-A-58-11548.

Each processing solution in the present invention is used at a temperature of 10° C. to 50° C. Although the normal processing temperature is 33° C. to 38° C., processing may be accelerated at a higher temperature to shorten the processing time, or image quality or stability of a processing solution may be improved at a lower temperature. In order to save silver for the light-sensitive material, processing using cobalt or hydrogen peroxide intensification described in West German Patent 2,226,770 and U.S. Pat. No. 3,674,499 may be performed.

A heater, a temperature sensor, a solution surface sensor, a circulation pump, a filter, a buoyant cover, a squeegee may be arranged in each processing bath.

In continuous processing, each processing solution is replenished to prevent variations in solution composition, thereby obtaining constant finish. The replenishing amount can be reduced to a half or less of the standard replenishing amount to reduce cost.

Bleach-fixing processing can be normally performed if the light-sensitive material according to the present invention is color paper. Bleach-fixing processing can be performed for a photographic color light-sensitive material as needed.

The present invention will be described in detail by way of practical examples. However, the present invention is not limited to the following examples.

EXAMPLE 1

An aqueous silver nitrate solution ($AgNO_3$; 18g) and an aqueous potassium bromide solution (KBr; 12.7g) were simultaneously added to 1l of an aqueous solution (pH: 5.0) containing 0.35g of potassium bromide and 40 g of gelatin kept at 75° C. over 20 minutes under stirring. An aqueous silver nitrate solution ($AgNO_3$; 156 g) and an aqueous potassium bromide solution (1.65M/l) were simultaneously added over 20 minutes in accordance with a flow rate acceleration method such that the final flow rate became 5.4 times the initial flow rate. During this period, the silver potential with respect to a saturated calomel electrode was kept at −25 mV.

After grains were formed, deslating and washing were performed in accordance with a normal flocculation method, and then gelatin and water were added to the resultant solution.

The resultant silver bromide emulsion comprised monodisperse octahedral grains having a grain diameter of 0.49 μm and a variation coefficient of 7.7%.

This emulsion was divided into 21 parts, and the pH and pAg were adjusted as shown in Table 1. Each emulsion sample was heated to 60° C., and sensitizers shown in Table 1 were added thereto to perform chemical ripening. Numbers (1) to (3) in Table 1 represent the numbers of times of repetition of an experiment including compound synthesis.

The pH and pAg were set to be 6.3 and 8.4, respectively, and the following materials were added to the samples:

gelatin
4-hydroxy-6-methyl-1,3,3a,7-tetraazaindene
potassium polystyrene sulfonate
sodium dodecylbenzene sulfonate The mixture was coated together with a protective layer containing gelatin, polymethylmethacrylate grains, a 2,4-dichloro-6-hydroxy-s-triazine sodium salt on a triacetylcellulose film support having a undercoating layer in accordance with an extrusion method.

The resultant samples were subjected to sensitometry exposure (1 second) through an optical wedge and were developed with a Kodak D-19 developing solution at 20° C. for 10 minutes. The development was stopped, and the resultant samples were fixed, washed, and dried. The densities of the samples were measured.

The relative sensitivity was represented by a relative value of a reciprocal value of an exposure amount required for obtaining an optical fog density of +0.1, and the relative sensitivity of sample 1 was defined as 100.

TABLE 1

| Sample | Sensitizer | (content: mol/mol Ag) | pH | pAg | Fog | Relative Sensitivity | |
|---|---|---|---|---|---|---|---|
| 1 | Sodium thiosulfate | (1) ($1.6 \times 10^{-5}$) | 6.3 | 8.4 | 0.04 | 100 | Comparative Example |
| 2 | Sodium thiosulfate | (2) ($1.6 \times 10^{-5}$) | " | " | 0.04 | 96 | Comparaitve Example |
| 3 | Colloidal tellurium*1 | (1) ($1.2 \times 10^{-4}$) | " | " | 0.09 | 126 | Comparative Example |
| 4 | Colloidal tellurium*1 | (2) ($1.2 \times 10^{-4}$) | " | " | 0.03 | 40 | Comparative Example |
| 5 | Colloidal tellurium*1 | (3) ($1.2 \times 10^{-4}$) | " | " | 0.04 | 63 | Comparative Example |
| 6 | $K_2Te$*2 | (1) ($8 \times 10^{-5}$) | " | " | 0.05 | 112 | Comparative Example |
| 7 | $K_2Te$*2 | (2) ($8 \times 10^{-5}$) | " | " | 0.03 | 25 | Comparative Example |
| 8 | $K_2Te$*2 | (3) $8 \times 10^{-5}$) | " | " | 0.03 | 32 | Comparative Example |
| 9 | None | | " | " | 0.02 | 16 | Comparative Example |
| 10 | Compound-3 | (1) ($9.6 \times 10^{-5}$) | 6.3 | 7.8 | 0.05 | 178 | Present Invention |
| 11 | Compound-3 | (2) ($9.6 \times 10^{-5}$) | " | " | 0.05 | 176 | Present Invention |

TABLE 1-continued

| Sample | Sensitizer (content: mol/mol Ag) | | pH | pAg | Fog | Relative Sensitivity | |
|---|---|---|---|---|---|---|---|
| 12 | Compound-1 | (1) ($1.1 \times 10^{-4}$) | 5.3 | 9.4 | 0.04 | 107 | Present Invention |
| 13 | Compound-1 | (2) ($9.6 \times 10^{-4}$) | " | " | 0.04 | 109 | Present Invention |
| 14 | Compound-6 | (1) ($7.2 \times 10^{-5}$) | 7.3 | 8.4 | 0.04 | 141 | Present Invention |
| 15 | Compound-6 | (2) ($7.2 \times 10^{-5}$) | " | " | 0.04 | 144 | Present Invention |
| 16 | Compound-10 | (1) ($1.2 \times 10^{-5}$) | 5.3 | 9.4 | 0.04 | 110 | Present Invention |
| 17 | Compound-10 | (2) ($1.2 \times 10^{-5}$) | " | " | 0.04 | 108 | Present Invention |
| 18 | Compound-15 | (1) ($8 \times 10^{-5}$) | 6.3 | 8.4 | 0.04 | 126 | Present Invention |
| 19 | Compound-15 | (2) ($8 \times 10^{-5}$) | " | " | 0.04 | 125 | Present Invention |
| 20 | Compound-17 | (1) ($1.1 \times 10^{-4}$) | 6.3 | 8.4 | 0.03 | 89 | Present Invention |
| 21 | Compound-17 | (2) ($1.1 \times 10^{-4}$) | " | " | 0.03 | 91 | Present Invention |

*1Compound (prepared in Example 2) described in Canadian Patent 800,958.
*2Compound described in Canadian Patent 800,958 and British Patent 1,295,462.

As is apparent from Table 1, the conventional tellurium sensitizers such as colloidal tellurium and $K_2Te$ may sometimes have high speed, but have poor reproducibility.

To the contrary, the compounds themselves according to the present invention had high stability and can be sufficiently chemically specified and purified. Although activity changed and ripening conditions (for example, pH and pAg) had to be adjusted in accordance with compound species, the compounds had reproducibility almost equal to sulfur sensitization (sodium thiosulfate) and gave high sensitivity. Reproducibility was also excellent even if the final sensitivity was low.

Tellurium sensitization with excellent reproducibility could be achieved by the compounds of the present invention.

EXAMPLE 2

A silver bromide emulsion as in Example 1 was prepared. This emulsion was divided into 12 parts. The pH and pAg of these emulsion samples were adjusted, as shown in Table 2. The samples were heated to 60° C., and tellurium sensitizers shown in Table 2 were added to the samples. After 20 minutes, the pH and pAg were adjusted to be 6.3 and 8.4, respectively. Chloroauric acid ($1.2 \times 10^{-5}$ mol/mol AgX), potassium thiocyanate ($3 \times 10^{-3}$ mol/mol AgX), and sodium thiosulfate ($1.2 \times 10^{-5}$ mol/mol AgX) were added to the samples, and the samples were ripened for 40 minutes.

Numbers (1) to (3) in Table 2 represent the numbers of times of repetition as in Example 1. Results in Table 2 were obtained following the same procedures as in Example 1. Relative sensitivities were measured such that the relative sensitivity of sample 30 was defined as 100.

TABLE 2

| Sample | Sensitizer (content: mol/mol Ag) | | pH | pAg | Fog | Relative Sensitivity | |
|---|---|---|---|---|---|---|---|
| 30 | — | | 6.3 | 8.4 | 0.08 | 100 | Comparative Example |
| 31 | Collodal tellurium*1 | (1) ($8 \times 10^{-5}$) | " | " | 0.08 | 79 | Comparative Example |
| 32 | Colloidal tellurium*1 | (2) ($8 \times 10^{-5}$) | " | " | 0.25 | 148 | Comparative Example |
| 33 | Colloidal tellurium*1 | (3) ($8 \times 10^{-5}$) | " | " | 0.09 | 105 | Comparative Example |
| 34 | Compound-3 | (1) ($9.6 \times 10^{-5}$) | 6.3 | 7.8 | 0.08 | 126 | Present Invention |
| 35 | Compound-3 | (2) ($9.6 \times 10^{-5}$) | " | " | 0.08 | 128 | Present Invention |
| 36 | Compound-6 | (1) ($4.8 \times 10^{-5}$) | 7.3 | 8.4 | 0.08 | 115 | Present Invention |
| 37 | Compound-6 | (2) ($4.8 \times 10^{-5}$) | " | " | 0.08 | 113 | Present Invention |
| 38 | Compound-13 | (1) ($8 \times 10^{-5}$) | 6.3 | 8.4 | 0.08 | 105 | Present Invention |
| 39 | Compound-13 | (2) ($8 \times 10^{-5}$) | " | " | 0.08 | 107 | Present Invention |
| 40 | Compound-15 | (1) ($8 \times 10^{-5}$) | 6.3 | 8.4 | 0.07 | 110 | Present Invention |
| 41 | Compound-15 | (2) ($8 \times 10^{-5}$) | " | " | 0.07 | 113 | Present Invention |

*1Comparative compound as in Example 1.

As is apparent from Table 2, colloidal tellurium serving as a conventional tellurium sensitizer had poor repetition reproducibility, while the compounds according to the present invention had excellent reproducibility and gave higher sensitivity.

EXAMPLE 3

An aqueous silver nitrate solution and an aqueous potassium bromide solution were simultaneously added to an aqueous gelatin solution containing potassium bromide kept at 40° C. under stirring. The resultant mixture was heated to 75° C., and ammonia was added thereto. The resultant solution was ripened and was then neutralized with acetic acid. An aqueous silver nitrate solution and a solution mixture of potassium iodide, potassium bromide, and $K_3IrCl_6$ ($3\times10^{-6}$ mol/mol Ag) were simultaneously added. A shell was then formed by using an aqueous silver nitrate solution and an aqueous potassium bromide solution.

The temperature of the resultant solution wa reduced to 35° C. after addition of the above solutions. Desalting and washing were performed in accordance with the flocculation method, and gelatin and water were added and dissolved.

The resultant tabular silver halide grains had an average diameter of 1.38 μm and a thickness of 0.19 μm. The average diameter/thickness ratio was 7.3, and the content of the silver iodide was 6 mol%.

The resultant emulsion was divided into 8 parts, and each emulsion sample was heated to 56° C. Sensitizing dye anhydro-5-chloro-5'-phenyl-9-ethyl-3, 3'-di(3-sulfopropyl)oxacarbocyanine were added, and sensitizers shown in Table 3 were added. After of 20 minutes, the pH and pAg were adjusted to be 6.3 and 8.6, respectively. Chloroauric acid ($1.6\times10^{-5}$ mol/mol AgX), potassium thiocyanate ($1\times10^{-3}$ mol/mol AgX), sodium thiosulfate ($8\times10^{-6}$ mol/mol AgX), and N,N-dimethylselenourea ($2\times10^{-6}$ mol/mol AgX) were added to the samples, and chemical ripening was performed for 30 minutes.

The following compounds were added, and the resultant solution was coated together with a protective film on a triacetylcellulose film support having a undercoating layer in accordance with an extrusion method.

(1) Emulsion layer
Emulsion: emulsions listed in Table 3
Coupler

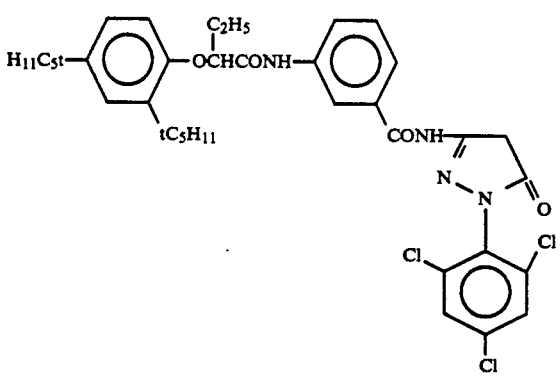

Tricresyl phosphate
1-(3-sulfophenyl)-5-mercaptotetrazole monosodium salt
4-hydroxy-6-methyl-1,3,3a,7-tetraazaindene
Potassium polystyrene sulfonate
Sodium dodecylbenzene sulfonate
(2) Protective layer
Polymethylmethacrylate fine grains
1,2-bis(vinylsulfonylacetylamino)ethane
Gelatin The resultant samples were subjected to sensitometry exposure (1/100 second), and the following color development processing was performed.

The densities of the processed samples were measured using a green filter. The resultant photographic performance is summarized in Table 3.

The relative sensitivity was represented by a relative value of a reciprocal value of an exposure amount required for obtaining an optical fog density of +0.2, and the relative sensitivity of sample 50 was defined as 100.

The development processing was performed at 38° C. under the following conditions:

| | |
|---|---|
| 1. Color development | 2 minutes 45 seconds |
| 2. Bleaching | 6 minutes 30 seconds |
| 3. Washing | 3 minutes 15 seconds |
| 4. Fixing | 6 minutes 30 seconds |
| 5. Washing | 3 minutes 15 seconds |
| 6. Stabilizing | 3 minutes 15 seconds |

The processing solution compositions used in the respective steps are given as follows:

| | |
|---|---|
| Color developing solution | |
| Sodium nitrilotriacetate | 1.0 g |
| Sodium sulfite | 4.0 g |
| Sodium Carbonate | 30.0 g |
| Potassium bromide | 1.4 g |
| Hydroxylamine sulfate | 2.4 g |
| 4-(N-ethyl-N-β-hydroxyethylamino)-2-methyl-aniline sulfate | 4.5 g |
| Water to make | 1 l |
| Bleaching solution | |
| Ammonium bromide | 160.0 g |
| Ammonia water (28%) | 25 ml |
| Ferric sodium ethylenediamine- | 130 g |
| Glacial acetic acid | 14 ml |
| Water to make | 1 l |
| Fixing solution | |
| Sodium tetrapolyphosphate | 2.0 g |
| Sodium sulfite | 4.0 g |
| Ammonium thiosulfate (70%) | 175.0 ml |
| Sodium disulfite | 4.6 g |
| Water to make | 1 l |
| Stabilizing solution | |
| Formalin | 8.0 ml |
| Water to make | 1 l |

TABLE 3

| Sample | Sensitizer | (content: mol/mol Ag) | pH | pAg | Fog | Relative Sensitivity | |
|---|---|---|---|---|---|---|---|
| 50 | | — | 6.3 | 8.6 | 0.32 | 100 | Comparative Example |
| 51 | $K_2Te^{*1}$ | (1) ($8\times10^{-5}$) | " | " | 0.50 | 109 | Comparative Example |
| 52 | $K_2Te^{*1}$ | (2) ($8\times10^{-5}$) | " | " | 0.28 | 64 | Comparative Example |

TABLE 3-continued

| Sample | Sensitizer (content: mol/mol Ag) | | pH | pAg | Fog | Relative Sensitivity | |
|---|---|---|---|---|---|---|---|
| 53 | $K_2Te$*1 | (3) ($8 \times 10^{-5}$) | " | " | 0.32 | 100 | Comparative Example |
| 54 | Compound-3 | (1) ($8 \times 10^{-5}$) | 6.3 | 7.9 | 0.26 | 108 | Present Invention |
| 55 | Compound-3 | (2) ($8 \times 10^{-5}$) | " | " | 0.26 | 108 | Present Invention |
| 56 | Compound-15 | (1) ($6.4 \times 10^{-5}$) | 6.3 | 8.6 | 0.22 | 95 | Present Invention |
| 57 | Compound-15 | (2) ($6.4 \times 10^{-5}$) | " | " | 0.22 | 96 | Present Invention |

*1Comparative compound as in Example 1.

As is apparent from Table 3, the compounds according to the present invention had better reproducibility than $K_2Te$ serving as a conventional tellurium sensitizer, had sensitivities equal to or higher than those of the conventional $K_2Te$, and could properly suppress the fog.

Stable tellurium sensitization with excellent reproducibility can be performed by the compounds of the present invention as compared with the conventional sensitizers.

What is claimed is:

1. A silver halide photographic light-sensitive material having at least one silver halide emulsion layer on a support, wherein at least one of the silver halide emulsion layers contains at least one compound represented by formula (I): formula (I)

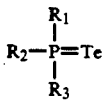

wherein $R_1$, $R_2$, and $R_3$ each represent an aliphatic group, an aromatic group, a heterocyclic group, $OR_4$, $NR_5(R_6)$, $SR_7$, $OSiR_8(R_9)(R_{10})$, $TeR_{11}$, X, or a hydrogen atom, $R_4$, $R_7$, and $R_{11}$ each represent an aliphatic group, an aromatic group, a heterocyclic group, a hydrogen atom, or a cation, R5 and R6 each represent an aliphatic group, an aromatic group, a heterocyclic group, or a hydrogen atom, $R_8$, $R_9$, and $R_{10}$ each represent an aliphatic group, and X represents a halogen atom.

2. The silver halide photographic light-sensitive material according to claim 1, wherein in formula (I), $R_1$, $R_2$, and $R_3$ each represent an aliphatic group, an aromatic group, $OR_4$ or $NR_5(R_6)$, and $R_4$, $R_5$, and $R_6$ each represent an aliphatic or aromatic group.

3. The silver halide photographic light-sensitive material according to claim 1, wherein in formula (I), $R_1$, $R_2$, and $R_3$ each represent a straight-chain, branched chain or cyclic alkyl group or an aromatic group.

4. The silver halide photographic light-sensitive material according to claim 1, wherein in formula (I), the aliphatic group represented by $R_1$, $R_2$, $R_3$, $R_4$, $R_5$, $R_6$, $R_7$, $R_8$, $R_9$, $R_{10}$, or $R_{11}$ has 1-30 carbon atoms.

5. The silver halide photographic light-sensitive material according to claim 1, wherein in formula (I), the aromatic group represented by $R_1$, $R_2$, $R_3$, $R_4$, $R_5$, $R_6$, $R_7$, or $R_{11}$ has 6-30 carbon atoms.

6. The silver halide photographic light-sensitive material according to claim 1, wherein in formula (I), the heterocyclic group represented by $R_1$, $R_2$, $R_3$, $R_4$, $R_5$, $R_6$, $R_7$, or $R_{11}$ is a 3 to 10-membered saturated or unsaturated heterocyclic group containing at least one atom selected from the group consisting of nitrogen, oxygen and sulfur.

7. The silver halide photographic light-sensitive material according to claim 1, wherein in formula (I), the cation represented by $R_4$, $R_7$, or $R_{11}$ is an alkali metal or ammonium.

8. The silver halide photographic light-sensitive material according to claim 1, wherein the compounds represented by formula (I) are selected from the group consisting of the following compounds:

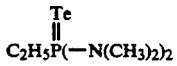

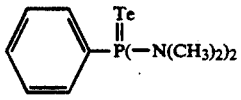

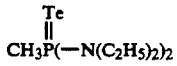

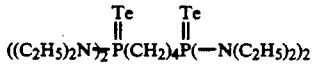

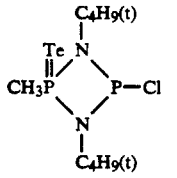

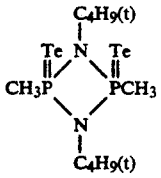

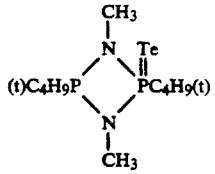

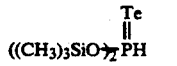

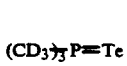

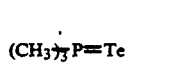

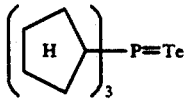

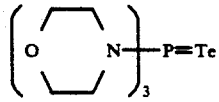

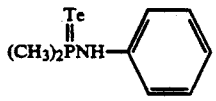

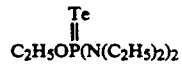

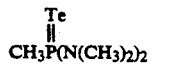

-continued $(C_2H_5)_2PN(C_2H_5)_2$ (Te)

$(C_2H_5)_2N)_3P{=}Te$ $H_2PNH_2$ (Te)

$(C_8H_{17})_3P{=}Te$ $HP(OH)_2$ (Te)

$HP(NH_2)_2$ (Te)

$(H_2N)_3P{=}Te$

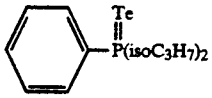

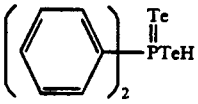

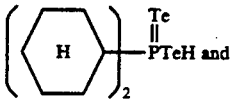

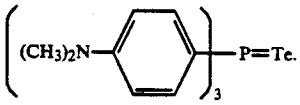

9. The silver halide photographic light-sensitive material according to claim 1, wherein the compound of formula (I) is present in an amount of $10^{-8}$ to $10^{-2}$ mol per mol of silver halide.

10. A silver halide photographic light-sensitive material having at least one silver halide emulsion layer on a support, wherein at least one of the silver halide emulsion layers contains a silver halide emulsion subjected to sensitization using at least one compound represented by formula (I): formula (I)

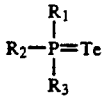

wherein $R_1$, $R_2$, and $R_3$ each represented an aliphatic group, an aromatic group, a heterocyclic group, $OR_4$, $NR_5(R_6)$, $SR_7$, $OSiR_8(R_9)(R_{10})$, $TeR_{11}$, X or a hydrogen atom, $R_4$, $R_7$, and $R_{11}$ each represent an aliphatic group, an aromatic group, a heterocyclic group, a hydrogen atom, or a cation, $R_5$ and $R_6$ each represent an aliphatic group, an aromatic group, a heterocyclic group, or a hydrogen atom, $R_8$, $R_9$, and $R_{10}$ each represent an aliphatic group, and X represents an halogen atom.

11. The silver halide photographic light-sensitive material according to claim 10, wherein in formula (I), $R_1$, $R_2$, and $R_3$ each represent an aliphatic group, an aromatic group, $OR_4$ or $NR_5(R_6)$, and $R_4$, $R_5$, and $R_6$ each represent an aliphatic or aromatic group.

12. The silver halide photographic light-sensitive material according to claim 10, wherein in formula (I), $R_1$, $R_2$, and $R_3$ each represent a straight-chain, branched chain or cyclic alkyl group or an aromatic group.

13. The silver halide photographic light-sensitive material according to claim 10, wherein in formula (I), the aliphatic group represented by $R_1$, $R_2$, $R_3$, $R_4$, $R_5$, $R_6$, $R_7$, $R_8$, $R_9$, $R_{10}$, or $R_{11}$ has 1-30 carbon atoms.

14. The silver halide photographic light-sensitive material according to claim 10, wherein in formula (I), the aromatic group represented by $R_1$, $R_2$, $R_3$, $R_4$, $R_5$, $R_6$, $R_7$, or $R_{11}$ has 6-30 carbon atoms.

15. The silver halide photographic light-sensitive material according to claim 10, wherein in formula (I), the heterocyclic group represented by $R_1$, $R_2$, $R_3$, $R_4$, $R_5$, $R_6$, $R_7$, or $R_{11}$ is a 3 to 10-membered saturated or unsaturated heterocyclic group containing at least one atom selected from the group consisting of nitrogen, oxygen and sulfur.

16. The silver halide photographic light-sensitive material according to claim 10, wherein in formula (I), the cation represented by $R_4$, $R_7$, or $R_{11}$ is an alkali metal or ammonium.

17. The silver halide photographic light-sensitive material according to claim 10, wherein the compounds represented by formula (I) are selected from the group consisting of the following compounds:

$(nC_4H_9)_3P{=}Te$ $(tC_4H_9)_3P{=}Te$

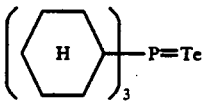

$(C_2H_5)_3P{=}Te$ $(nC_3H_7)_3P{=}Te$ $(iso\text{-}C_3H_7)_3P{=}Te$

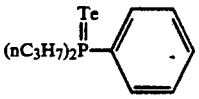

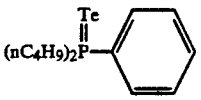

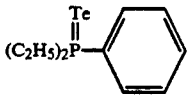

$(isoC_4H_9)_3P{=}Te$ $(nC_8H_{17})(isoC_3H_7)_2P{=}Te$ $(nC_4H_9)_2(isoC_3H_7)P{=}Te$ $(isoC_4H_9)(isoC_3H_7)_2P{=}Te$ $(isoC_4H_9)_2(isoC_3H_7)P{=}Te$ $(nC_4H_9)(isoC_3H_7)_2P{=}Te$ $C_2H_5P(OC_2H_5)_2$ (Te)

$H_2C{=}CHCH_2P(OC_2H_5)_2$ (Te) $C_2H_5P(-N(CH_3)_2)_2$ (Te)

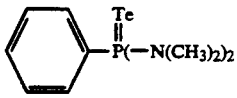

$CH_3P(-N(C_2H_5)_2)_2$ (Te)

$((CH_3)_2N)_3P{=}Te$ $((C_2H_5)_2N)_2P(CH_2)_4P(-N(C_2H_5)_2)_2$ (Te, Te)

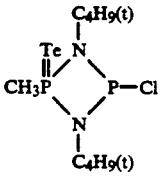

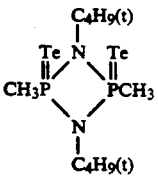

-continued

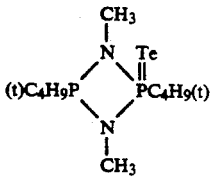

$(nC_5H_{11})_3P{=}Te$ $((CH_3)_3SiO)_2\overset{Te}{\overset{\|}{P}}H$ $(CD_3)_3P{=}Te$ $(CH_3)_3P{=}Te$

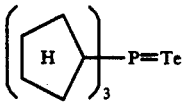

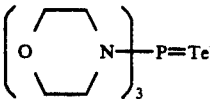

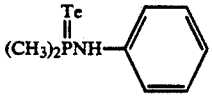

$C_2H_5O\overset{Te}{\overset{\|}{P}}(N(C_2H_5)_2)_2$ $CH_3\overset{Te}{\overset{\|}{P}}(N(CH_3)_2)_2$ -continued $(C_2H_5)_2\overset{Te}{\overset{\|}{P}}N(C_2H_5)_2$ $(C_2H_5)_2N)_3P{=}Te$ $H_2\overset{Te}{\overset{\|}{P}}NH_2$ $(C_8H_{17})_3P{=}Te$ $HP(OH)_2\overset{Te}{\overset{\|}{}}$ $HP(NH_2)_2\overset{Te}{\overset{\|}{}}$ $(H_2N)_3P{=}Te$

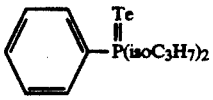

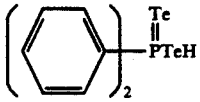

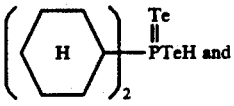

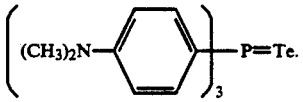

18. The silver halide photographic light-sensitive material according to claim 10, wherein the compound of formula (I) is present in an amount of $10^{-8}$ to $10^{-2}$ mol per mol of silver halide.

* * * * *